US006713961B2

(12) United States Patent
Honda et al.

(10) Patent No.: US 6,713,961 B2
(45) Date of Patent: Mar. 30, 2004

(54) HIGH-INTENSITY DISCHARGE LAMP, SYSTEM FOR LIGHTING THE LAMP AND LIGHTING APPLIANCE USING THE LAMP

(75) Inventors: Hisashi Honda, Kanagawa-ken (JP); Sadao Sakaguchi, Kanagawa-ken (JP); Seiji Ashida, Kanagawa-ken (JP); Shigehisa Kawatburu, Kanagawa-ken (JP); Kazuhiro Miyagawa, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 481 days.

(21) Appl. No.: 09/731,860

(22) Filed: Dec. 8, 2000

(65) Prior Publication Data

US 2001/0003411 A1 Jun. 14, 2001

(30) Foreign Application Priority Data

Dec. 8, 1999 (JP) ..... 11-349538

(51) Int. Cl.[7] ..... H01J 11/00

(52) U.S. Cl. ..... 313/607; 313/234; 313/567; 313/594

(58) Field of Search ..... 313/567, 594, 313/607, 234

(56) References Cited

U.S. PATENT DOCUMENTS 5,998,915 A * 12/1999 Scholz et al. ..... 313/234
6,054,810 A * 4/2000 Yamamoto et al. ..... 313/607
6,198,223 B1 * 3/2001 Scholz ..... 313/623
6,552,502 B2 * 4/2003 Okamoto et al. ..... 315/336
6,563,267 B1 * 5/2003 Van Den Nieuwenhuizen et al. ..... 313/594

* cited by examiner

*Primary Examiner*—Edward J. Glick
*Assistant Examiner*—Jurie Yun
(74) *Attorney, Agent, or Firm*—Pillsbury Winthrop LLP

(57) ABSTRACT

The invention provides the high-intensity discharge lamp and the high-intensity discharge lamp lighting system and the lighting system using the high-intensity discharge lamp showing the low enough starting voltage. The high-intensity discharge lamp comprising a lighting-source bulb provided with an enclosure, a light-transmissive ceramic enclosure defining a pair of small-diameter cylinders communicating with the enclosure at both ends thereof, a pair of electrodes and discharge agent, a metallic coil which is wound on the outside surface of at least one small-diameter cylinder and coupled to the other end of the electrode to have the same potential with the electrode, a jacket-bulb which hermetically accommodates therein the lighting-source bulb and the metallic coil, and a pair of outer lead terminals which are coupled to the pair of electrodes and hermetically led outside the jacket-bulb. The metallic coil is preferably wound for four turns or more on the small-diameter cylinder, and placed its one end near the boundary to the enclosure of the light-transmissive ceramic discharge enclosure, and the winding pitch of the metallic coil resides in the range of 100% to 500%. Further, the length L2 of the metallic coil is 0.3 to 1.0 times the length of the small-diameter cylinder. Furthermore, the end of it which is opposite to the enclosure is coupled to have the same potential as the other electrode.

10 Claims, 9 Drawing Sheets

HIGH-INTENSITY DISCHARGE LAMP, SYSTEM FOR LIGHTING THE LAMP AND LIGHTING APPLIANCE USING THE LAMP

FIELD OF THE INVENTION

The present invention relates to a high-intensity discharge lamp, which is provided with a light-transmissive ceramic discharge enclosure, a high-intensity discharge lamp lighting system employing the high-intensity discharge lamp, and a lighting appliance using the lamp.

BACKGROUND OF THE INVENTION

Recently, the inventors of the present invention have devised a compact metal halide lamp whose lamp power is about 10 to 30 W for a light source suited for optical fibers or a substitutive light source for a halogen lamp and a compact high-intensity discharge lamp, i.e., a screw-base-mount type high-intensity discharge lamp in which the metal halide lamp, a compact lighting circuit for lighting the metal halide lamp and a screw base are integrally assembled together. The screw-base-mount type high-intensity discharge lamp has a lamp efficiency which is about three to four times higher than that of the halogen lamp, and which is remarkably smaller in size than that of the screw-base-mount type fluorescent lamp, so as to be treated as a point-source of light.

However, since the lamp belongs to a high-intensity discharge lamp, it requires a stabilizer comprising therein an igniter for generating a relatively high voltage pulse at a starting operation, i.e., a lighting circuit. Alternatively it requires a stand-alone igniter and a lighting circuit not including such an igniter. Accordingly, even if a compact high-intensity discharge lamp would be devised for all troubles, an overall system comprised of a light source, a stabilizer or a lighting circuit and a lighting unit results to have a large size. On the other hand, a compact fluorescent lamp and a screw-base-mount type fluorescent lamp in which such a fluorescent lamp is integrated with its lighting circuit have been used as a light source alternative to an incandescent lamp. Since such a screw-base-mount type fluorescent lamp also belongs to a discharge lamp, it requires a lighting circuit. However the lighting circuit of the screw-base-mount type fluorescent lamp is overwhelmingly small in comparison with that of the high-intensity discharge lamp.

As a result of the studies to solve the above problem, the inventor had achieved success of employing a lighting circuit principally constituted by a compact high-frequency inverter which is used for the screw-base-mount type fluorescent lamp as the lighting circuit of the compact high-intensity discharge lamp. Since the lighting circuit mentioned above is generally simple in its circuit arrangement, and works at a high frequency, it is compact, light in weight and less expensive. Accordingly, it is realize a high-intensity discharge lamp lighting system which is compact, light weight, and less expensive.

However, if it is possible to lower the starting voltage for the high-intensity discharge lamp it will realize a lighting circuit which is much more compact, light weight and less expensive.

Generally, the starting voltage for the discharge lamp follows a function of the distance between electrodes and the pressure of the discharge agent, that is, the Paschen's law in a case that the conditions of the electrode and the discharge agent are fixed.

Accordingly, to lower the starting voltage it is common that the pressure of the discharge agent is lowered down, and the distance between the electrodes is shortened. According to the above measures, the starting voltage is certainly lowered. However, it causes several drawbacks such as increases of spattering or evaporation of tungsten constituting the electrodes which causes a blackening of the light-transmissive ceramic discharge enclosure, and thus results of lowering the luminous flux retention and/or the lighting efficiency.

There is another measure to provide a supplemental conductor nearby the electrodes for lowering the starting voltage. As such a conventional technique, it is known that both ends of a supplemental conductor is wound about two or three turns on each of the small-diameter cylinders at a portion nearby the boundary of the cylinder and the enclosure respectively. And then the mid-portion of the conductor is elongated along the enclosure. Here, the supplemental conductor is isolated from the electrodes and thus electrically disconnected therefrom.

As another conventional technique, it is known that respective one ends of a pair of supplemental conductors are wound about two or three turns on the mid-portions of a pair of elongated sealing portions of a light-transmissive silica discharge enclosure. The mid-portions of the supplemental conductors are elongated along the enclosure in leaving appropriate distance from the enclosure. While respective other ends of the supplemental conductors are coupled to the outer lead wires of the opposite side sealed portions.

However, in the conventional techniques employing such a supplemental conductor it is found that the supplemental conductor does not always work effectively.

SUMMARY OF THE INVENTION

The present invention has an object to provide a high-intensity discharge lamp which operates at a low starting voltage, a high-intensity discharge lamp lighting device employing the high-intensity discharge lamp, and a lighting appliance.

A high-intensity discharge lamp according to the first aspect of the invention comprises a lighting-source bulb provided with a light-transmissive ceramic discharge enclosure containing an enclosure defining a discharge space and a pair of small-diameter cylinders communicating with the enclosure at both ends thereof and having an inside diameter smaller than the enclosure, a pair of slender electrodes extending through the small-diameter cylinders of the light-transmissive ceramic discharge enclosure in leaving narrow gaps between the inside surfaces of the small-diameter cylinders and the electrodes and a discharge agent filled in the light-transmissive ceramic discharge enclosure; a metallic coil which is wound on at least one of the small-diameter cylinders through which one of the electrodes extends, and which is coupled to the other end of the electrode to have the same potential with the electrode, a jacket-bulb which hermetically accommodates therein the lighting-source bulb and the metallic coil and a pair of outer lead terminals which are coupled to the pair of electrodes and hermetically led outside the jacket-bulb.

In the following descriptions, there will be made definitions and their technical meanings for presenting following specific terms, unless otherwise specified.

Herein-below the high-intensity discharge lamp will be described for each of its components.

Lighting-Source Bulb

The lighting-source bulb is provided with at least a light-transmissive ceramic discharge enclosure, a pair of electrodes and discharge agent.

Discharge Lamp Light-Transmissive Ceramic Enclosure

The term "light-transmissive" means a transmissivity allowing light generated by a discharge to be led outside. Accordingly the term may include not only a transparency but also a light-diffusiveness. When the light-transmissive ceramic discharge enclosure is provided with a small-diameter cylinder, it is essential only that the enclosure has a transmissivity to radiation to be utilized. While the small-diameter cylinder or the portion that may not utilize the radiation by the discharge can be light-tight.

Accordingly, the term "light-transmissive ceramic discharge enclosure" means a discharge enclosure comprised of at least an enclosure which is made of monocrystalline metal oxide, e.g., sapphire, polycrystalline metal oxide, e.g., semi-transparent hermetic aluminum oxide (alumina-ceramics), yttrium-aluminum garnet (YAG), yttrium oxide (YOX) and polycrystalline nonoxidic material, e.g., material having a light-transmissivity and a heat-resistancy like aluminum mitride (AIN).

Further, in making the light-transmissive ceramic discharge enclosure, one or a pair of small-diameter cylinders may be integrated with the enclosure by coupling the cylinder(s) to opposite two ends of the enclosure at the first step. However, for instance, it is also able to make the integrated light-transmissive ceramic discharge enclosure by provisionally sintering a hollow spherical portion presenting the enclosure and a pair of small-diameter cylinders presenting the small-diameter cylinders after appropriately assembling them step-by-step, and then finally sintering whole of them. Further, it is also able to form an integrated discharge enclosure by, e.g., provisionally sintering a large-diameter cylinder presenting an enclosure, a pair of end plates to be fit to both ends of the cylinder for closing the ends and a pair of small-diameter cylinders to be fit into central holes defined in the end plates after appropriately fitting them step-by-step, and the finally sintering whole of them.

Furthermore, in the present invention, the interior volume of the light-transmissive ceramic discharge enclosure is particularly effective at a small volume, less than 0.05 cc, or preferably less than 0.04 cc in order to achieve a compact high-intensity discharge lamp. However it is not necessarily limited to the specific volume. In this case, the length of the light-transmissive ceramic discharge enclosure is less than 35 mm. or preferably between 10 to 30 mm.

Electrodes

The pair of electrodes are made of the materials such as tungsten or doped tungsten, and sealed in the light-transmissive ceramic discharge enclosure. Here, the electrodes elongate in the small-diameter cylinders of the light-transmissive ceramic discharge enclosure, and the inside end of it may be located in the enclosure. However the inside end of the electrode may be located at a position facing the enclosure so as to cause the discharge in the enclosure.

Furthermore, in a state that the slender electrode is inserted into the small-diameter cylinder, there is left a narrow gap or so called a capillary between the electrode and the inside surface of the small-diameter cylinder. In such a case, it is desirable that the mid-portion of the electrode has a uniform thickness so as to leave a uniform space between the electrode and the inside surface of the small-diameter cylinder of the light-transmissive ceramic discharge enclosure.

Further, the inside end of the electrode could be wound thereon a coil made of tungsten as needed, so as to enlarge its surface area to enhance heat dissipation.

Furthermore, the outside end of the electrode is fixed to a place appropriate for the light-transmissive ceramic discharge enclosure so as to work for receiving power from outside.

Further, the outside end of the electrode is fixed to the inside end of the feed-conductor by welding or the like, so that the electrode is electrically and mechanically supported by the feed-conductor. In this case, it is allowable that the feed-conductor is added with refractory portion made of material such as molybdenum or cermet, as a place interposed between the feed-conductor and the outside end of the electrode at fixing of them to the electrode.

Discharge Agent

The discharge agent contains rare gas as starting gas and buffer gas. The discharge agent is filled in the light-transmissive ceramic discharge enclosure so as to present one atmospheric pressure or more during the operation of the lamp.

Further, the discharge agent contains light emitting material or its compound such as metal halide or amalgam.

Furthermore, the discharge agent is able to contain mercury as buffer vapor.

On the other hand, the rare gas is not essentially limited to specific gas. However, in the case that it is desirable to lower a glow current or a discharge starting voltage at a transfer from a normal glow discharge to an abnormal glow discharge, neon and argon may be filled in the enclosure in combination with the rare gas. In this case, the argon is mixed with the neon at a ratio of 0.1 to 15%, or preferably less than 10%. Further, the neon and the argon are used at ambient pressure of generally 80 to 500 torr, or preferably 100 to 200 torr. Here, if the ambient pressure is less than 80 torr, the glow-arc transition time becomes longer, and the blackening due to the spattering or the evaporation of the tungsten constituting the electrode becomes increase.

On the other hand, if the gas pressure exceeds 500 torr, the starting voltage for starting lighting of the high-intensity discharge lamp rises, and thus the glow power also increases.

Furthermore, in addition to the neon or the argon, other kinds of rare gas can be filled in the enclosure as needed.

In the case that the high-intensity discharge lamp is a sort of metal halide lamps, when light-yielding metal halide is used for the discharge agent, it is able to use one or a plurality of them from a group of iodine, bromine, chlorine and fluorine as halogen for constituting the metal halide.

The light-yielding metal halide is able to be selected from a group of known metal halides, in order to achieve radiation provided with a desired lighting characteristics about a light color, an average color rendering evaluation index Ra and a lighting efficiency, and further in response to the size and lamp power of the discharge lamp lighting-transmissive ceramic enclosure. For instance, one or a plurality of halides selected among a group of Na-halide, Li-halide, Sc-halide or rare-earth metal-halides could be used.

Further, as buffer vapor it is able to contain not only an appropriate amount of mercury but also metal halide such as aluminum halide with a relatively high vapor pressure and less contributive or non-contributive to lighting operation.

Other Components of Lighting-Source Bulb (1) Feed-Conductor

A feed-conductor as described below is suitable in structure for supporting electrodes, feeding power to the electrode and sealing the light-transmissive ceramic discharge enclosure.

That is, the feed-conductor serves to support the electrode, apply a voltage across the electrodes, supply a discharge current to the electrodes and seal the light-transmissive ceramic discharge enclosure. The inside end of the feed-conductor is coupled to the outside ends of the electrodes directly or via a refractory portion as described below. While the outside end of the feed-conductor resides outside the light-transmissive discharge enclosure. Here, the phrase "resides outside the light-transmissive discharge enclosure" means that it could protrude outside the light-transmissive discharge enclosure, or it could not always protrude outside but face to outside at a degree capable of feeding power from outside via a junction conductor.

Further, the feed-conductor is able to be used for supporting the entire of the high-intensity discharge lamp by supporting the electrode.

Furthermore, the feed-conductor could be made of the sealable metal such as niobium, tantalum, titanium, zirconium, hafnium and vanadium. In case of using alumina-ceramics as the material of the light-transmissive ceramic discharge enclosure, since the niobium and the tantalum have almost same average thermal expansion coefficient as that of the aluminum oxide, they are suitable for the feed-conductors. In case of using the yttrium oxide and the YAG, there is no significant difference in their thermal expansion coefficients. In case of using the aluminum nitride, it is recommendable lo use the zirconium for the feed-conductors.

Further, the feed-conductor is able to be shaped like a rod, a pipe or a coil made of the metal as mentioned above. In this case, since the niobium is a sort of oxidizable metal, it is needed to couple an additional oxidation-resistive external lead-wire to the feed-conductor, and coat, e.g., sealing material over the feed-conductor so as that the feed-conductor does not expose in air.

Further, it is able to add a refractory portion, which is made of refractory metal, over the outside end of the feed-conductor as mentioned above. The refractory portion is able to be made of molybdenum, tungsten or cermet. However, if needed, the fixed end of the electrode may be coupled directly to the inside end of the sealable portion of the feed-conductor. It means that if at least the free end of the refractory portion to be added to the feed-conductor is made of tungsten, the refractory portion is able to be used as the electrode. On the contrary, the fixed end of the electrode is able to be used as the refractory portion. Both configurations are substantially the same with each other.

(2) Lamp Power

If the lamp power of the high-intensity discharge lamp is less than 50 W, it is easy to make the lighting circuit compact. However it is not necessarily limited to the specific value.

Here, the term "lamp power" means power which is consumed in the high-intensity discharge lamp under the condition that the high-intensity discharge lamp is operated by the lighting circuit and keeps stable lighting.

Metallic Coil

The metallic coil is wound on at least one of the small-diameter cylinders of the light-transmissive ceramic discharge enclosure through which a pair of electrodes extend, and one end of the coil is coupled to the other electrode to have the same potential as the other electrode. That is, the metallic coil(s) is/are able to be arranged for one or both of the electrodes. And a high voltage is applied across the metallic coil and the electrode which faces to the coil at a starting of operation. Accordingly, the phrase "one end of the metallic coil is coupled to the other electrode to have the same potential as the other electrode" means that one end of the metallic coil is coupled to the feed-conductor or the junction conductor coupled to the feed-conductor when the electrode to which the metallic coil faces via a small-diameter cylinder represents the one electrode.

Further, it is preferable that the metallic coil is wound on the small-diameter cylinder as tight as possible.

Furthermore, it is able to use heat-resistant conductive metal such as molybdenum or niobium as the metallic coil. Accordingly, when such a junction conductor is used for feeding power to the lighting-source bulb, the junction conductor can be made of the same metal as that of the metallic coil. However it may be made of different kind of metal.

Jacket-Bulb

The jacket-bulb is a device for hermetically accommodating therein the lighting-source bulb.

In the high-intensity discharge lamp according to the present invention, the light-transmissive ceramic discharge enclosure is hermetically accommodated in the jacket-bulb for insulating heat or blocking outside air. In order to realize the heat insulation and the air-blocking, the jacket-bulb is evacuated, or filled with inert gas such as rare gas or nitrogen.

Further it is assumed that the jacket-bulb is made of material having proper transparency, hermeticity, heat-resistant and machinability. For instance, it is practical to use hard glass, semi-hard glass or silica glass. If needed, it is able to use light-transmissive ceramics or crystalline glass.

Further, the jacket-bulb could be formed in either a single closed-end structure or a double closed-end structure, as needed. If the jacket-bulb is made in the single closed-end structure, it is effective for the case of the lighting system employing a reflector whose optical axis is conformed to the optical axis of the high-intensity discharge lamp.

Further, the known sealing techniques such as pinch-sealing, flare sealing, bead sealing, or button stem sealing are adopted for sealing the jacket-bulb.

Outer Lead Terminal

A pair of outer lead terminals are coupled to the pair of electrodes of the lighting-source bulb which are accommodated in the jacket-bulb. Further, they are led outside the jacket-bulb so as to work as means for receiving electric energy from the outside lighting circuit and for supporting the high-intensity discharge lamp. Further, in case of using the junction conductor for feeding power to the lighting-source bulb, the outer lead terminals are able to be integrated with the junction conductors. However, they are individually formed and then coupled together by fixing means such as welding via sealable metal in the sealed portion of the jacket-bulb. Further, the pair of outer lead terminals can be brought together at one end of the sealed portion of the jacket-bulb and be extended outside the jacket-bulb. Accordingly, it becomes easy to couple the lighting circuit to the high frequency output terminal. However, the pair of outer lead terminals are separately lead out from both ends of the jacket-bulb desirably.

Further, the outer lead terminals may protrude outside the jacket-bulb, or may be placed on the jacket-bulb. In a structure that the outer lead terminal protrudes outside the jacket-bulb, the protrusion may constitute a connection pin as it is or it may work as a connection wire to the screw-base. On the other hand, in the configuration that the outer lead terminals are placed on the jacket-bulb, when the positions on which the outer lead terminals are placed on the jacket-bulb are selected to the portion of the pinch-sealing, it will become a non-screw-base structure. Furthermore, the pair of outer lead terminals could be provided with a structure and material preferable for connecting to the high frequency output terminal of the lighting circuit. So, although at least sealable metal can be used at a portion where the outer lead terminal passes through the sealed portion of the jacket-bulb, a contact piece made of brass, copper or the like which has low contact resistance and sufficient mechanical strength can be used at a portion to be coupled to the lighting circuit.

Other Components

1. Junction Conductor

The junction conductor interposing between the pair of electrodes and the outer lead terminals in the jacket-bulb is able to be used in order to apply the starting voltage and supply the discharge current to the lighting-source bulb.

Further, the junction conductor could be made of metal having heat-resistancy and conductivity such as molybdenum or niobium.

2. Support of Lighting-Source Bulb

The lighting-source bulb is supported to a prescribed position in the jacket-bulb by any one of following manners.

(1) The lighting-source bulb is supported by only the junction conductor.

(2) A support frame which is bumped against the inside surface of the jacket-bulb is provided with the junction conductor supporting the lighting-source bulb.

(3) The lighting-source bulb is bumped against the inside surface of the jacket-bulb by curving the junction conductor.

(4) The junction conductor coupled to the lighting-source bulb is engaged to the inside surface of a tip-off portion of the jacket-bulb directly or indirectly via other material.

(5) The light-transmissive ceramic discharge enclosure of the lighting-source bulb is directly supported by the supporting band having elasticity, e.g., instead of the junction conductor.

3. Power Receiving Means

A power receiving means may be mounted on the jacket-bulb for coupling the high-intensity discharge lamp to the lighting circuit. For a power receiving device, an appropriate device such as a screw-base used for every types of lamp, a cap of a hook-type ceiling jack which is used for feeding power to the sealing lighting unit, an insulated wire for directly coupling the high frequency output terminal to the lighting circuit can be adopted.

In case of adopting the screw-base for the receiving device, an appropriate one can be selected from various types of known screw-base. However, if it is attached a great importance to a compatibility for existing incandescent lamps or screw-base-mount type fluorescent lamps, it is desirable to use a screw-base having the same specifications as those of them.

As the lamp-base, every types of bases such as a screw-base, a pin-base or a bayonet-base could be adopted, as required or optionally. However, since a compact high-intensity discharge lamp having the lighting power less than 50 W is able to be constituted substitutable for the halogen lamp, if needed an E11 type screw-base which is used for a commercial power supply voltage.

Then, the screw-base which is coupled to one end of the jacket-bulb is mounted on the lamp socket, so that the high-intensity discharge lamp is simply and easily attached.

Accordingly, it is able to substitute the high-intensity discharge lamp for the halogen lamp.

4. Getter

To absorb impurity gas in the jacket-bulb, the getter is mounted in the jacket-bulb, as conventionally used. In this case, the getter is supported by a proper member ouch as the light-transmissive ceramic discharge enclosure or the junction conductor.

Operations of the Invention

In the high-intensity discharge lamp according to this aspect of the invention, the electrode extends through the small-diameter cylinder in leaving narrow gaps between the electrode and the inside surface of the small-diameter cylinder. The discharge agent in the liquid-phase stays in the narrow gaps during a stable lighting. And the surface or the interface of the liquid-phase discharge agent becomes the coldest portion which determines the vapor pressure of the discharge agent. However, in a glow discharge operation, the discharge agent staying in the narrow gap temporarily evaporates. It is desirable that the discharge agent evaporates within a proper time at a starting operation.

In this aspect of the invention, since the metallic coil is wound on at least one of the small-diameter cylinders of the light-transmissive ceramic discharge enclosure a relatively high voltage is applied across the electrode and the metallic coil which is wound on the small-diameter cylinder facing the electrode at a starting operation. So that a weak discharge occurs across the ceramics of the small-diameter cylinder between the electrode and the metallic coil to support the operation. Accordingly the starting voltage is remarkably lowered. And, since the metallic coil faces a vicinity of the surface of the discharge agent the vapor of the discharge agent is stimulated at a starting operation.

Further, since a by-pass for electric energy is caused by the weak discharge which is generated by the arrangement of the metallic, the glow-arc transition time at the electrode facing the metallic coil tends to be extended in comparison to that in the case that there is no metallic coil. Thus the metallic coil is effective for optimizing the glow-arc transition time. Accordingly the metallic coil is able to suppress the blackening at a starting operation.

A high-intensity discharge lamp according to the second aspect of the invention comprises a lighting-source bulb provided with a light-transmissive ceramic discharge enclosure containing an enclosure defining a discharge space and a pair of small-diameter cylinders communicating with the enclosure at both ends thereof and having an inside diameter smaller than the enclosure, a first and a second slender electrodes extending through the small-diameter cylinders of the light-transmissive ceramic discharge enclosure in leaving narrow gaps between the inside surfaces of the small-diameter cylinders and the electrodes and a discharge agent filled in the light-transmissive ceramic discharge enclosure, a first metallic coil which is wound on the outside surface of the one end of the small-diameter cylinder wherein the first electrode is inserted through, and which is coupled to have the same potential as the second electrode, a second metallic coil which is wound on the other small-diameter cylinder through which the second electrode extends, and which is coupled to the first electrode to have the same potential as the electrode, a jacket-bulb which accommodates the lighting-source bulb and the first and the second metallic coils hermetically and a pair of outer lead terminals which are coupled to the first and the second electrodes and hermetically led outside the jacket-bulb.

In this aspect of the invention, the first and the second metallic coils are wound on the small-diameter cylinders in confronting with the first and the second electrodes.

Thus, in this aspect of the invention, the starting voltage lowers further in comparison to that in a case that the metallic coil is wound on only one of the electrodes.

Further, since the first and the second metallic coils are wound on the both first and the second electrodes, it is effective to optimize the glow-arc transition time of each electrode at a good balance. So, the glow-arc transition time at each of the electrodes are easy to become identical and thus the blackening at a starting operation is all the more depressed.

A high-intensity discharge lamp according to the third aspect of the invention comprises a lighting-source bulb provided with a light-transmissive ceramic discharge enclosure containing an enclosure defining a discharge space and a pair of small-diameter cylinders communicating with the enclosure at both ends thereof and having an inside diameter smaller than the enclosure, a pair of slender electrodes extending through the small-diameter cylinders of the light-transmissive ceramic discharge enclosure in leaving narrow gaps between the inside surfaces of the small-diameter cylinders and the electrodes and discharge agent filled in the light-transmissive ceramic discharge enclosure, a first metallic coil which is wound on the outside surface of the one end of the small-diameter cylinder wherein one of the electrodes is inserted through, and which is coupled to the other electrode to have the same potential as the electrodes, a second metallic coil which is wound on the other small-diameter cylinder wherein the other electrode is inserted through, a jacket-bulb which accommodates the lighting-source bulb and the first and the second metallic coils hermetically and a pair of outer lead terminals which are coupled to a pair of electrodes and hermetically led outside the jacket-bulb.

This aspect of the invention is identical with that of the second aspect of he invention in respect that a pair of metallic coils are wound on the small-diameter cylinder, but the second metallic coil is not coupled to the other electrode. That is, the second metallic coil is electrically isolated from the electrode. However, the second metallic coil is electrostatically coupled to the second electrode.

Then, in this aspect of the invention, it is identical with that of claims mentioned above at a point that the other metallic coil is wound on the small-diameter cylinder. In addition, the second metallic coil is also wound on the small-diameter cylinder, so it tends to extend the glow-arc transition time of the second electrode at a starting operation. Accordingly, it will be easy to control the glow-arc transition time of the second electrode at a starting operation in the desirable range. That is, it is somewhat effective to depress the blackening at a starting operation.

A high-intensity discharge lamp according to the fourth aspect of the invention, is characterized by that, further to the high-intensity discharge lamps according to the any of the first to third aspects of the invention, the metallic coil is wound on the small-diameter cylinder more than four turns.

This fourth aspect of the invention defines an effective number of turns of the metallic coil.

That is, the operation of the metallic coil is affected by the number of turns of the metallic coil. In the case that the number of turns is less than four, it is difficult to achieve enough function for decreasing the starting voltage. The reason is not always apparent, but it is assumed that it relates to the electrostatic capacitance. In such a sense, it is desirable to tightly wind the metallic coil on the small-diameter cylinder so as to make the gap narrow as much as possible.

On the other hand, the upper limit of the number of turns of the metallic coil is decided by the size of the light-transmissive ceramic discharge enclosure in the axial direction.

Accordingly, a proper number of turns of the metallic coil is able to be defined in order to achieve the desirable starting voltage in the range that the metallic coil is possible to be wound on the small-diameter cylinder. Further this aspect of the invention is also effective for mainly aiming to adjust the glow-arc transition time at a starting operation in the desirable range.

A high-intensity discharge lamp according to the fifth aspect of the invention, is characterized by that, further to the high-intensity discharge lamp according to any one of the first to fourth aspect of the invention, one end of the metallic coil is placed near the boundary of the enclosure of the light-transmissive ceramic discharge enclosure.

This fifth aspect of the invention defines a suitable place for arranging the metallic coil.

That is, since one end of the metallic coil is placed near the enclosure of the light-transmissive ceramic discharge enclosure, it will make the positioning and fixing of the metallic coil easy. Further, it is able to design the high-intensity discharge lamp wherein the surface of the discharge agent faces the metallic coil.

A high-intensity discharge lamp according to the sixth aspect of the invention, is characterized by that further to the high-intensity discharge lamp according to any one the first to fifth aspects of the invention, the winding pitch of the metallic coil resides in the range of 100% to 500%.

This sixth aspect of the invention defines a suitable winding pitch of the metallic coil.

The term "winding pitch" means the ratio of the distance between centers of adjacent two turns of the coil to the diameter of the metal wire for forming the coil. Accordingly, in case of the winding pitch is 100%, it indicates that the coil is wound in tight. Further, in case of that the winding pitch is 500%, a gap four times wider than the diameter of the metallic wire shaping the coil is defined between adjacent two turns.

In this aspect of the invention, if the winding pitch exceeds 500%, it will become somewhat difficult to wind a coil on the small-diameter cylinder not only in tight as much as possible, but also preventing looseness of coils after windings. Further, though the coils touch each other between turns next to when the winding pitch is 100%, it cannot be the problem especially.

Then, in this aspect of the invention, the winding of the metallic coil is easily performed and the decrease of the starting voltage is effective.

A high-intensity discharge lamp according to the seventh aspect of the invention, is characterized by that further to the high-intensity discharge lamp according to any one of the first to sixth aspects of the invention, the value of L1/L2 will be 0.3 to 1.0, when the length of the metallic coil is denoted as L1 and the length of the small-diameter cylinders of the light-transmissive ceramic discharge enclosure is denoted as L2.

This aspect of the invention defines a suitable length L1 in the axial direction of the metallic coil to the length L2 of the small-diameter cylinder.

That is, the metallic coil is wound over the entire length of the small-diameter cylinder. The metallic coil may have the length longer than the small-diameter cylinder by 0.3 times, at the shortest.

A high-intensity discharge lamp according to the eighth aspect of the invention, is characterized by that further to the high-intensity discharge lamp according to any one of the first to seventh aspects of the invention, the one end of the metallic coil which placed an the opposite end of the enclosure of the light-transmissive ceramic discharge enclosure is coupled to be the same potential as that of the other end.

This aspect of the invention defines the suitable selection of the end of the metallic coil to be coupled to the electrode. That is the end of the metallic coil placed on the opposite end of the enclosure is coupled to the electrode, so as to decrease the effect of the connecting portion of the metallic coil on the distribution of the light of the high-intensity discharge lamp. Further, when the metallic coil is coupled to the electrode, the enclosure of the light-transmissive ceramic discharge enclosure is hard to be disturbed, so as to enhance the coupling operability.

A high-intensity discharge lamp according to the ninth aspect of the invention, is characterized by that further to the high-intensity discharge lamp according to any one of the first to eighth aspects of the invention, the electrostatic capacitance across the pair of outer lead terminals are among 1.2 to 4 pF.

This aspect of the invention defines the electrostatic capacitance across the pair of outer lead terminals, which is suitable for decreasing the starting voltage.

The electrostatic capacitance across the pair of outer lead terminals are measured at a frequency of 40 kHz when the high-intensity discharge lamp is provided with the jacket-bulb and the metallic coil, and the screw-base is took off. Here, it is allowable that the interior of the jacket-bulb is in the lower evacuated condition about 10 to 4 torr.

Then, since in this aspect of the invention there are provided the metallic coil, the electrostatic capacitance across the pair of outer lead terminals increases. So that, the little discharge is generated between the electrode and the metallic coil which faces the electrode via the ceramics at a starting operation, and the operation of this aspect of the invention is enhanced. So, the starting voltage is remarkably lowered.

Further, electric energy is by-passed via the electrostatic capacitance at a starting operation, and then that amount of electric energy is not applied to the electrode. So that, the glow-arc transition time is properly extended within a suitable range. Accordingly, it is able to prevent the blackening from occurring effectively at a starting operation.

Further, even in the case that the metallic coil is not coupled to the other electrode, the electrostatic capacitance across the pair of outer lead terminals increases.

A high-intensity discharge lamp according to the tenth aspect of the invention, is characterized by that further to the high-intensity discharge lamp according to any one of the first to ninth aspects of the invention, the electrode is providing the metallic coil, which is wound on at least one part of its axis facing the metallic coil.

As a premise that the metallic coil is able to be placed inside the small-diameter cylinders of the light-transmissive ceramic discharge enclosure, the diameter of the wire, the number of turns and the winding pitch are not limited a specific one.

Further, the discharge agent comes and goes through the narrow gap left between the metallic coil and the small-diameter cylinder, and stays there in a liquid-phase during the lighting of the lamp.

So, in this aspect of the invention the metallic coil is placed on the shank of the electrode, so that the starting voltage is further decreased. Further, it is able to control the glow-arc transition time desirably, that means it is able to longer the glow-arc transition time. It is not apparent the reason for taking such an effect as mentioned above, but the reason is assumed that the area that the metallic coil faces the small-diameter cylinder increases but the length of the distance of them decreases. Then the electrostatic capacitance across them increases.

Further, this aspect of the invention is effective in the case that the diameter of the axis of the electrode is smaller than the inside diameter of the small-diameter cylinder, and that the gap is relatively wide.

A high-intensity discharge lamp lighting system according to the eleventh aspect of the invention comprises a high-intensity discharge lamp according to any one of the first to tenth aspects of the invention, and a lighting circuit which is made by principally an inverter for lighting the high-intensity discharge lamp at a high frequency region.

Arrangement of High-Intensity Discharge Lamp and Lighting Circuit

In this aspect of the invention, an only thing is that the high-intensity discharge lamp and the lighting circuit are electrically coupled with each other. They may be spatially apart to each other, or be physically coupled together. For instance, as the former example of arrangement, the high-intensity discharge lamp is mounted to the lighting unit. While the lighting circuit is located apart from the high-intensity discharge lamp, e.g., at a behind of ceilings. And the latter example is an arrangement for configuring the screw-base-mount type high-intensity discharge lamp as described below.

Lighting Circuit

1. In this aspect of the invention, the term "high frequency" means the frequency of around 5 kHz or higher.

2. A lighting circuit for fluorescent lamp is used to miniaturize the lighting circuit. The lighting circuit for the fluorescent lamp has a load characteristics smoothly extending from the second-order open-circuit voltage to the second-order short-circuit current.

In this aspect of the invention, the lighting circuit for the fluorescent lamp is able to be diverted for the present invention. Off course it is regardless to say that it is able to use the lighting circuit which is manufactured for the high-intensity discharge lamp to satisfy a predetermined load characteristics.

Furthermore, in this aspect of the invention, the second-order open-circuit voltage V20 of the lighting circuit is defined within the range having relatively great flexibility. That is, in general, the ratio V20/Vs (%) of the second-order open-circuit voltage V20 of the lighting circuit to the discharge starting voltage VS of the high-intensity discharge lamp is able to be defined in the following range.

$$110 \leqq V20 \leqq 300$$

Here, since the discharge starting voltage $V_S$ of the high-intensity discharge lamp statistically disperses, it is required to pay much attention to specie the discharge starting voltage $V_S$.

By the way, the principal circuit arrangement of the lighting circuit may be any type if it has the load characteristics as mentioned above. For instance, the stabilizer may have a circuit arrangement constituted by principally a half bridge inverter, a full-bridge inverter, a parallel inverter, a single-transistor type inverter such as a blocking oscillator inverter.

3. The operating frequency of the lighting circuit is defined in the range of 5 to 200 kHz.

4. It is able to use the lighting circuit which is constituted by principally a high-frequency inverter provided with an LC resonator.

As an inverter satisfying the requirements as mentioned above, it is able to be used a half bridge inverter, a single-transistor type inverter, e.g., a blocking oscillator inverter, or a parallel inverter.

The oscillation control of the inverter may be done by either of a self-excitation or a separate-excitation. Further, the oscillating frequency of the inverter may be constant or variable.

When the oscillating frequency of the inverter to the resonance frequency of the LC resonator varies in accordance with a situation, the output voltage of the stabilizer is able to be controlled by changing the oscillating frequency of the inverter. That is, if the oscillating frequency is brought closer to the resonance frequency of the LC resonator at a starting operation, the output voltage rises, and thus the second-order open-circuit voltage is able to be brought closer to the discharge starting voltage of the high-intensity discharge lamp. On the other hand, if the oscillating frequency is brought apart from the resonance frequency after lighting, the output voltage is reduced. Accordingly, it is possible to provide the lighting circuit with a load characteristics which smoothly extends from the second-order discharge voltage close to the discharge starting voltage of the high-intensity discharge lamp to the second-order short-circuit current.

Further, when the operating frequency is fixed, it is able to control the output voltage of the lighting circuit, by constituting the LC resonator so as that its resonance frequency varies in response to a situation. That is, when the inductor L of the LC resonator saturates at a non-loaded state, the inductance of the inductor L shrinks under saturation, while the resonance frequency rises and approach the operating frequency, so that the output voltage of the lighting circuit rises. Further, at a loaded state, the saturation of the inductor of the LC resonator is released according to the lamp current, so that the resonance frequency is estranged from the operating frequency and the output voltage is reduced.

Then, by using the inverter providing the LC resonator, the circuit arrangement of the lighting circuit is simplified, and thus it is possible to achieve all the more compact and inexpensive high-intensity discharge lamp lighting system.

Furthermore, since the lighting circuit is provided with the LC resonator, the waveform of the output voltage is able to be shaped to a sinusoidal waveform.

Glow-Arc Transition Time

By constructing the high-intensity discharge lamp wherein the glow-arc transition time is limited in the range of 0.5 to 3.0 sec, or preferably from 1.0 to 2.5 secs, the blackening at a starting operation will remarkably reduced, when the high-intensity discharge lamp is lighted by using a compact lighting circuit. The glow-arc transition time is achieved by measuring descent points an the voltage waveform on an oscilloscope and then calculating an average of five measured samples. Here, the descent points of the lamp voltage waveform have to be those at that the glow-arc transitions occur at both electrodes. Accordingly, the glow-arc transitions occur at a pair of electrodes at the same time. However, when there is a time lag between the glow-arc transitions on the electrodes, it will occur at the descent points of the electrode that the glow-arc transition occurs afterward.

By the way, if the glow-arc transition time is less than 0.5 secs, the glow-arc transition power is supplied heavily in a short time and the electrode is heated excessively. Thus, the evaporation of the electrode is performed excessively, the blackening is enhanced, and a luminous flux retention lowers too much. That is why it is improper.

Further, if the glow-arc transition time becomes longer more than 3.0 secs, the sputtering of the electrode becomes rather remarkable. Thus, the blackening at a starting operation is accelerated, and the luminous flux retention lowers. That is why it is improper.

Thus, if the glow-arc transition time is within the range of 0.5 to 3.0 secs, it will be able to maintain around the 80% or more of the luminous flux retention after 3,000 hours of lighting. Here, the lighting time mentioned above means the time or hours that the high-intensity discharge lamp was intermittently lighted by alternative repetitions of about 165 minutes of lighting and about 15 minutes of extinction.

Further, it is able to define the glow-arc transition time within the range mentioned above by properly defining the specifications of the high-intensity discharge lamp and making match with the lighting circuit.

A lighting appliance according to the twelfth aspect of the invention comprises a lighting appliance principal body, and a high-intensity discharge lamp lighting system according to the eleventh aspect of the invention which is mounted to the lighting appliance principal body.

In this aspect of the invention, the term "lighting appliance" has a wide concept including any devices for utilizing light radiated from the high-intensity discharge lamp in one object or another. For instance, the lighting appliance is able to be adapted to a screw-base-mount type high-intensity discharge lamp, a lighting unit, a mobile head light, a light source for optical fibers, an image projection device, an optic-chemical device, or a fingerprint discrimination device.

The term "lighting appliance principal body" means a whole portion of the lighting appliance except the high-intensity discharge lamp.

The term "screw-base-mount type high-intensity discharge lamp" means the lighting appliance in which the high-intensity discharge lamp and the stabilizer are integrated together, and further provided with a screw-base for receiving power when coupled to a lamp socket, so as to allow to be used in similar manner to the ordinary incandescent lamp.

Further, the lighting circuit of the high-intensity discharge lamp lighting system may be located in the lighting appliance principal body or at a place apart from the lighting appliance principal body such as a behind of ceilings.

Next, in case of constituting the screw-base-mount type high-intensity discharge lamp, it is able to provide a reflector for condensing light so as that the high-intensity discharge lamp presents a desired light distribution characteristics.

Furthermore, for moderately reducing the brightness of the high-intensity discharge lamp, it is able to provide a light diffusion glove, or a cover in place of or in addition to the reflector.

Further, it is able to use a screw-base having desirable specifications. Accordingly, for replacing directly with conventional light-source lamps, a screw-base the same as that of the conventional light-source lamps is able to be adopted.

By the way, the lighting appliance is a lighting unit, it may be configured that the lighting appliance principal body is provided with the lighting circuit and the lamp socket, and the high-intensity discharge lamp is coupled to the lamp socket. However, the screw-base-mount type high-intensity discharge lamp may be coupled to the lamp socket as a light source, when the lighting appliance principal body is not provided with the lighting circuit.

Additional objects and advantages of the present invention will be apparent lo persons skilled in the art from a study of the following description and the accompanying drawings, which are hereby incorporated in and constitute a part of this specification.

BRIEF DESCRIPTIONS OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Referring now to the attached drawings, FIGS. 1 to 9, some embodiments of the present invention will be explained hereinafter.

Figure 1:
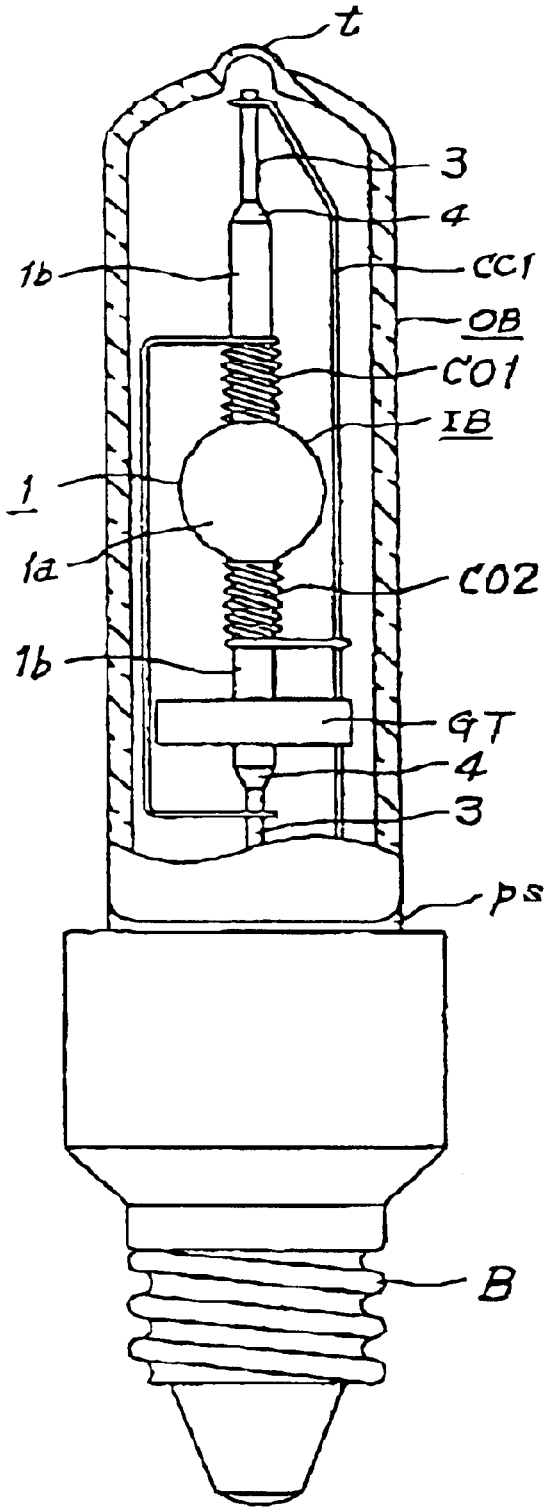
FIG. 1 is a partial section front view of a first embodiment of the high-intensity discharge lamp according to the present invention.

FIG. 1 is a partial section front view of the first embodiment of the high-intensity discharge lamp according to the present invention.

Figure 2:
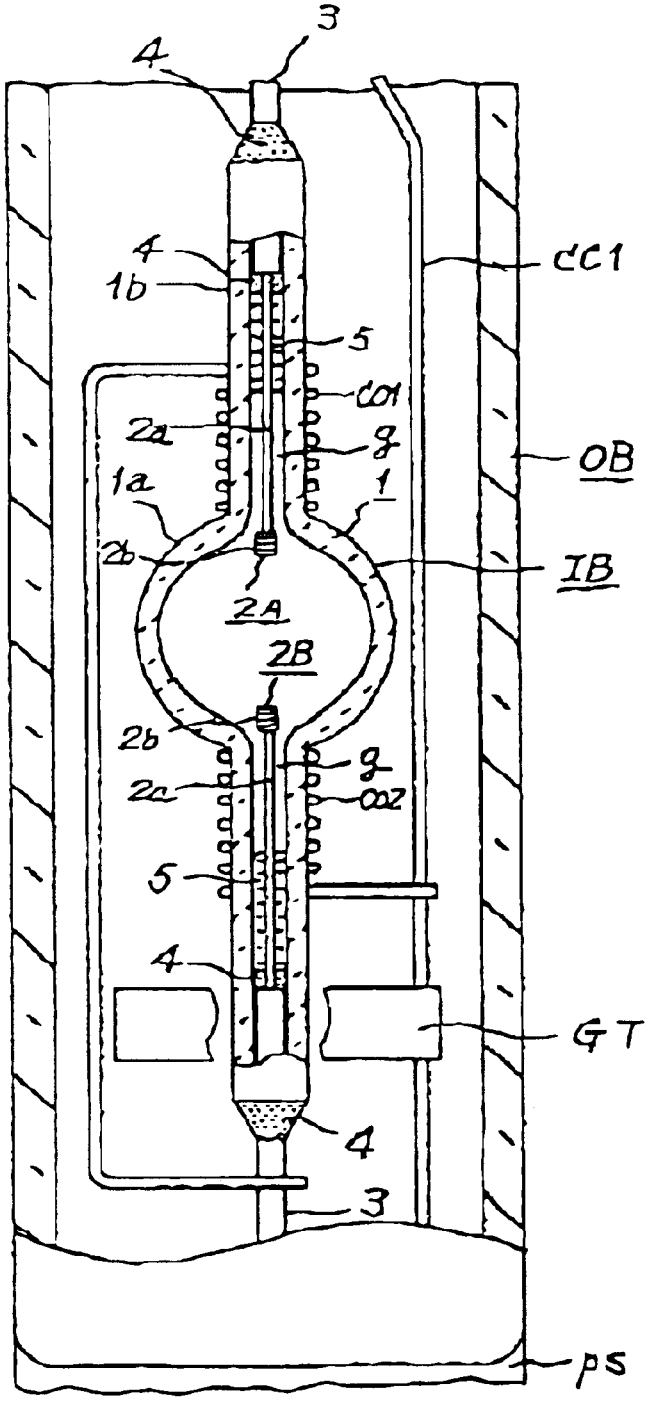
FIG. 2 is a partial enlarged section front view of the high-intensity discharge lamp.

FIG. 2 is an enlarged section front view of the high-intensity discharge lamp.

Figure 3:
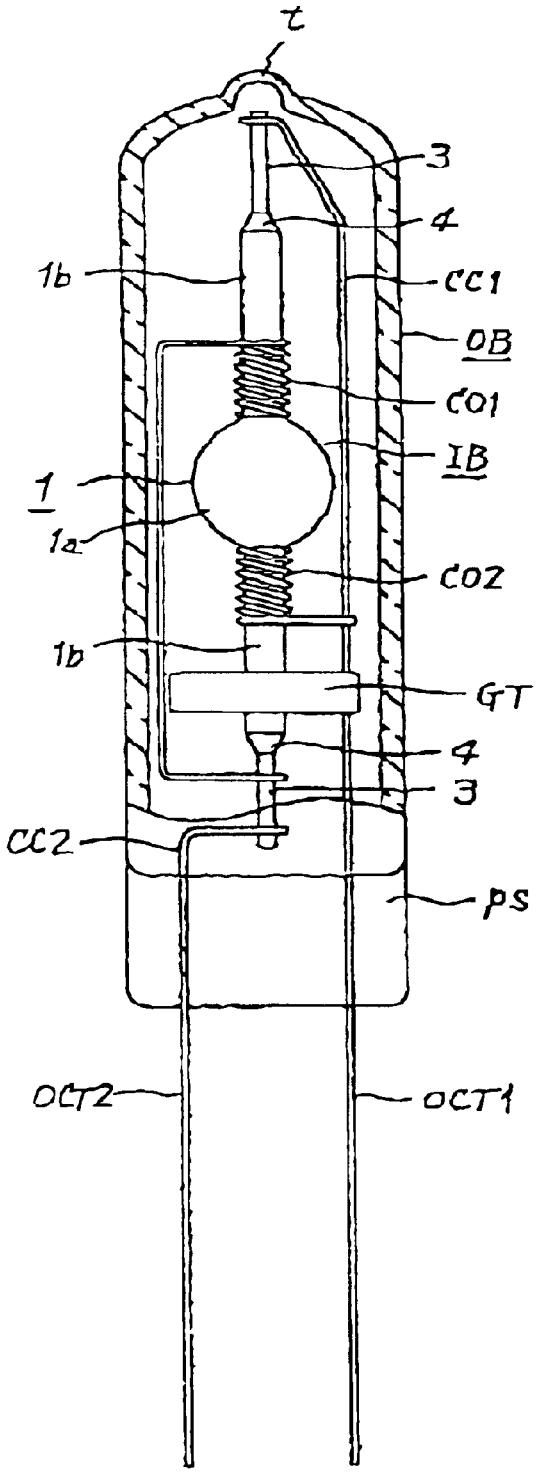
FIG. 3 is a partial section front view showing the wire bulb state before the screw-base is mounted.

FIG. 3 is a partial section front view showing the wire-bulb state before the screw-base is not mounted on the high-intensity discharge lamp.

In the drawings, the high-intensity discharge lamp is comprised of a lighting-source bulb IB, a first junction conductor CC1, a second junction conductor CC2, fist and second metallic coils CO1, Co2, a jacket-bulb OB, a pair of outer lead terminals OCT1, OCT2, a getter GT, and a screw-base B.

Lighting-Source Bulb IB

The lighting-source bulb IB is provided with a light-transmissive ceramic discharge enclosure 1, first and second electrodes 2A, 2B, a feed-conductor 3, a sealant 4, and a liquid-state discharge agent 5. And it is symmetrical in top and bottom.

The light-transmissive ceramic discharge enclosure 1 is provided with an enclosure 1*a*, and a pair of a small-diameter portions 1*b*, 1*b*.

The enclosure 1*a* is almost ball whose both ends are shrinked by smooth curved surface.

The small-diameter cylinder 1*b* is coupled to the enclosure 1*a* by a smooth curved surface so as to integrally form the light-transmissive ceramic discharge enclosure 1.

The first and the second electrodes 2A and 2B are made of doped tungsten, and they are provided with a rod shaped axis portion 2*a* and a coil portion 2*b*. The axis portion 2*a* is passed through the small-diameter cylinder 1*b* as the inside end of it protrudes into the enclosure 1*a*. So that the narrow gap g is left between the small-diameter cylinder 1*b* and the first and the second electrodes 2A and 2B.

The coil portion 2*b* is coupled to the axis portion 2*a*.

The feed-conductor 3 is made of niobium and shaped like a rod. The inside end of it is fit face-to-face manner to the outside end of the electrodes 2A and 2B and discharge-welded, and the outside end of it protrudes from the light-transmissive ceramic discharge enclosure 1.

The sealant 4 melts the ceramic sealing compound and hardened in order to not only seal the light-transmissive ceramic discharge enclosure 1 by entering between the small-diameter cylinder 1*b* of the light-transmissive ceramic discharge enclosure 1 and the sealable portion 2*a*, but only cover the feed-conductor 3 for preventing the feed-conductor from it exposure to the light-transmissive ceramic discharge enclosure 1. Further, the electrodes 2A and 2B are fixed to a predetermined position by the sealing.

To form a sealant, ceramic sealing compound is placed around the sealable portion of the light-transmissive ceramic discharge enclosure 1 which is located in a vertical position, and the portion protrudes outside the feed-conductor 3. So that, it is melted by heat and flow into the gap between the feed-conductor 3 and the groove portion 1*c*, thus, it covers not only the entire of the feed-conductor 3 which is passed through the small-diameter cylinder 1*b*, but also the outside end of the electrode 2, then it is hardened by cooling.

The discharge agent filled in the light-transmissive ceramic enclosure 1 is comprised of operating gas and buffer gas containing neon and argon, light-yielding metal halide and mercury as buffer vapor.

Further, since the metal halide and the mercury are filled in the light-transmissive ceramic enclosure 1 excessively over the evaporating amount, some of them stay in a narrow gap g in a liquid-phase during the stable lighting. Then the surface of the discharge agent 5 becomes the coldest portion.

Junction Conductors CC1, CC2

The fist junction conductor CC1 is made of a molybdenum wire, the inside end of it is coupled to the feed-conductor 3 at the side of the electrode 2A, and the mid-portion of it extends in parallel to and separately from the axial direction of the light-transmissive ceramic discharge enclosure 1.

The second junction conductor CC2 is made of the molybdenum, and the inside end of it is coupled to the feed-conductor 3 at the side of the electrode 2B.

Metallic Coils CO1, CO2

The first metallic coil CO1 its wound on the small-diameter cylinder 1*b* wherein the first electrode 2A is passed through. And the end of the coil at the side of the feed-conductor 3 extends apart from the axial direction of the light-transmissive ceramic discharge enclosure 1 and it is coupled to the feed-conductor 3 at the side of the second electrode 2B.

The second metallic coil CO2 is wound on the small-diameter cylinder 1*b* wherein the second electrode 2B is passed through. And the end of the coil at the side3 of the feed-conductor 3 is coupled to the first junction conductor CC2.

Jacket-Bulb OB

The jacket-bulb OB is made of the T-shaped hard glass bulb. A pinch-sealed portion ps is formed at the outside end of the jacket-bulb OB, and an evacuation pinch-off portion t is formed at the inside end of the jacket-bulb OB. The interior of the jacket-bulb is in the lower evacuated condition around 10 to 4 torr.

The pinch-sealed portion ps is formed by pinching the opening of the T-shaped bulb when the opening is softened by the heating.

The evacuation pinch-off portion t in a trace which had been left after evacuating the jacket-bulb OB through an exhaust pipe and pinching-off the pipe.

Outer Lead Terminals OCT1, OCT2

A pair of outer lead terminals OCT1 and OCT2 is integrated together with the first and the second junction conductor s CC1 and CC2 by extending those feed-conductors.

And it protrudes from the jacket-bulb OB before the screw-base B as the receiving means is mounted.

Getter GT

The getter GT is made of ZrAl alloy, and it is supported by the first junction conductor CC1 by welding.

Screw-Base B

The screw-base is an E11 type screw-base, and the pair of outer lead terminals OCT1 and OCT2 are coupled to it if needed. Further, it is fixed to the pinch-sealed portion ps of the jacket-bulb OB by inorganic adhesive.

EXAMPLES

It is the high-intensity discharge lamp, as shown in FIGS. 1 to 3. The high-intensity discharge lamp has following specifications.

Lighting-Source Bulb

Discharge lamp light-transmissive ceramic enclosure; made of light almina-ceramics; Length 23 mm, Enclosure 1*a* with Outside diameter 6 mm and Inside diameter 5 mm (Wall thickness 0.5 mm); Small-diameter cylinder 1*b* with Outside diameter 1.8 mm, and Inside diameter 0.7 mm (Wall thickness 0.5 mm); Length L2 8 mm.

Electrode; made of tungsten and having a shank and a coil portion both with a diameter of 0.2 mm Feed-conductor; made of niobium; and having a diameter of 0.64 mm Narrow gap g; 0.25 mm Discharge agent: Ne+Ar 3% 26.6 kPa (200 torr) as operating gas and buffer gas; and Proper quantity of mercury and halide of light-yielding metal. The light-yielding metal halide is filled in the enclosure by an amount that the metal halide does not completely evaporate, but surplus of the metal halide stays in the narrow gap.

First and second metallic coils: Molybdenum wire with a diameter 0.3 mm is wound on the small-diameter cylinder from a place near the enclosure by 7 turns at 200% of winding pitch. The length L1 is about 5 mm and the ratio (l1/L2):≠0.63.

Electrostatic capacitance across the pair of outer lead terminals: 2.3 pF

Operating voltage: 0.7 kVp-p (In comparative example having the same specifications as those of the present example but not provided with the first and the second metallic coils, its starting voltage were 3.0 kVp-p)

Figure 4:
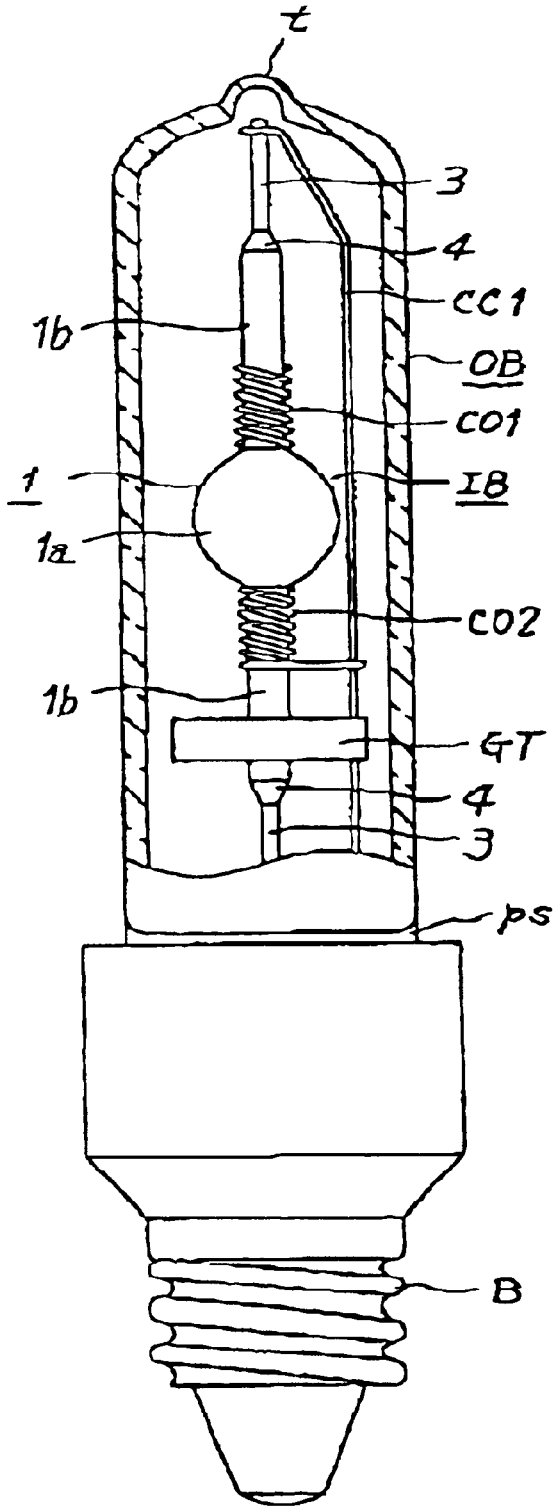
FIG. 4 is a partial section front view of the second embodiment of the high-intensity discharge lamp according to the present invention.

Glow-arc transition time: 1.4 secsin the first electrode, and 1.6 secs. in the second electrode FIG. 4 is a partial section front view showing the second embodiment of the high-intensity discharge lamp according to the present invention.

In FIG. 4, the same elements as those, as shown in FIG. 1, are assigned with the same marks.

This embodiment differs from others in that the first metallic coil CO1 is not coupled to the second electrode 2B.

That is, the first metallic coil CO1 is electrically isolated from the one electrode.

Then, the starting voltage is 1.0 kVp-p. And, the glow-arc transition time of the first electrode 2A is 0.7 secs, and that of the second electrode 2B is 1.5 secs.

Further, the electrostatic capacitance across the outer lead terminals OC1 and OCT2 becomes about 1.8 to 2.0 pF.

Figure 5:
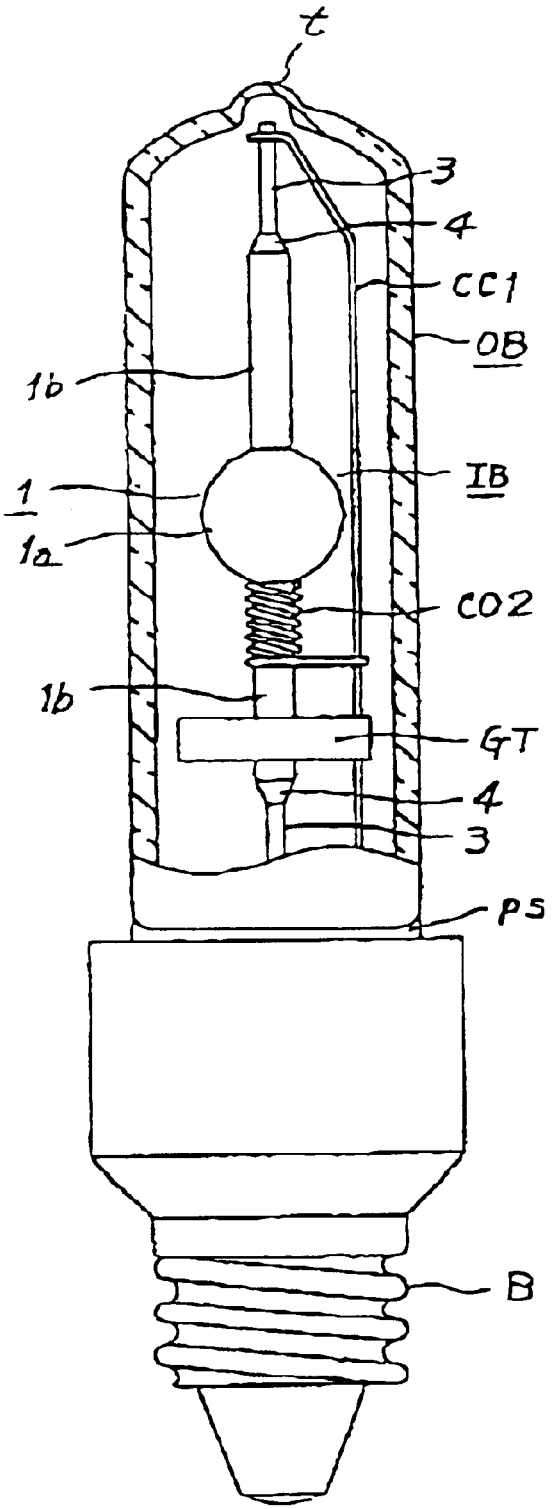
FIG. 5 is a partial section front view of the third embodiment of the high-intensity discharge lamp according to the present invention.

FIG. 5 is a partial section font view showing the third embodiment of the high-intensity discharge lamp according to the present invention.

In FIG. 5, the same elements as those, as shown in FIG. 1, are assigned with the same marks.

This embodiment differs from others in that only the second metallic coil CO2 is wound on the small-diameter cylinder.

Then, the starting voltage is 1.1 kVp-p. And, the glow-arc transition time of the first electrode 2A is 0.6 secs, and that of the second electrode 2B is 1.4 secs.

Further, the electrostatic capacitance across the outer lead terminal OC1 and OCT2 becomes about 1.3 to 1.8 pF.

Figure 6:
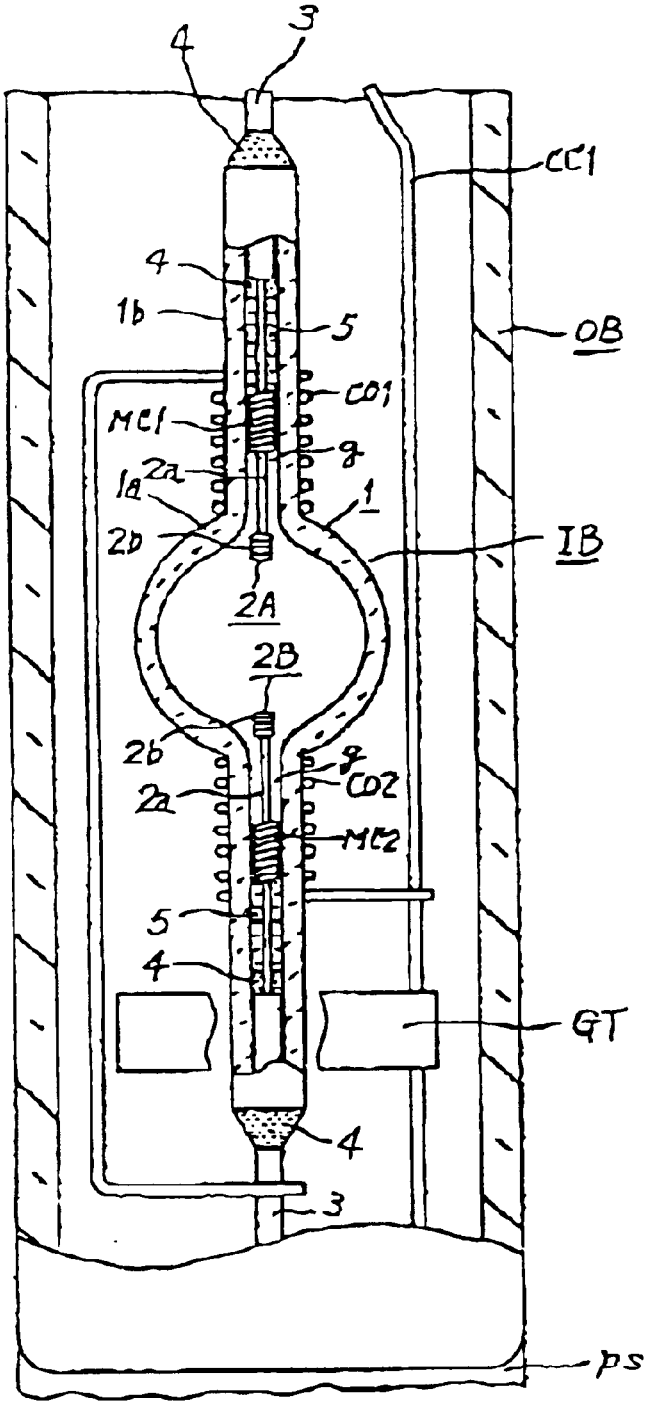
FIG. 6 is a partial enlarged section front view of the forth embodiment of the high-intensity discharge lamp according to the present invention.

FIG. 6 is a partial enlarged section front view showing the fourth embodiment of the high-intensity discharge lamp according to the present invention.

In FIG. 5, the same elements as those, as shown in FIG. 2, are assigned with the same marks.

This embodiment differs from others in that the metallic coils MC1 and MC2 are wound on the portion where the axis portions 2*a* of the both electrodes 2A and 2B face to the metallic coils CO1 and CO2.

That is, the metallic coils MC1 and MC2 are shaped by winding a 0.2 mm thick tungsten wire by eight turns around the axis portion 2*a* of the electrodes.

Accordingly, not only a narrow gap with about 0.05 mm is left between the metallic coils CO1, CO2 and the inside surface of the small-diameter cylinder 1*b*, but also another gap is also left extending spirally between the metallic coils CO1, CO2.

Figure 7:
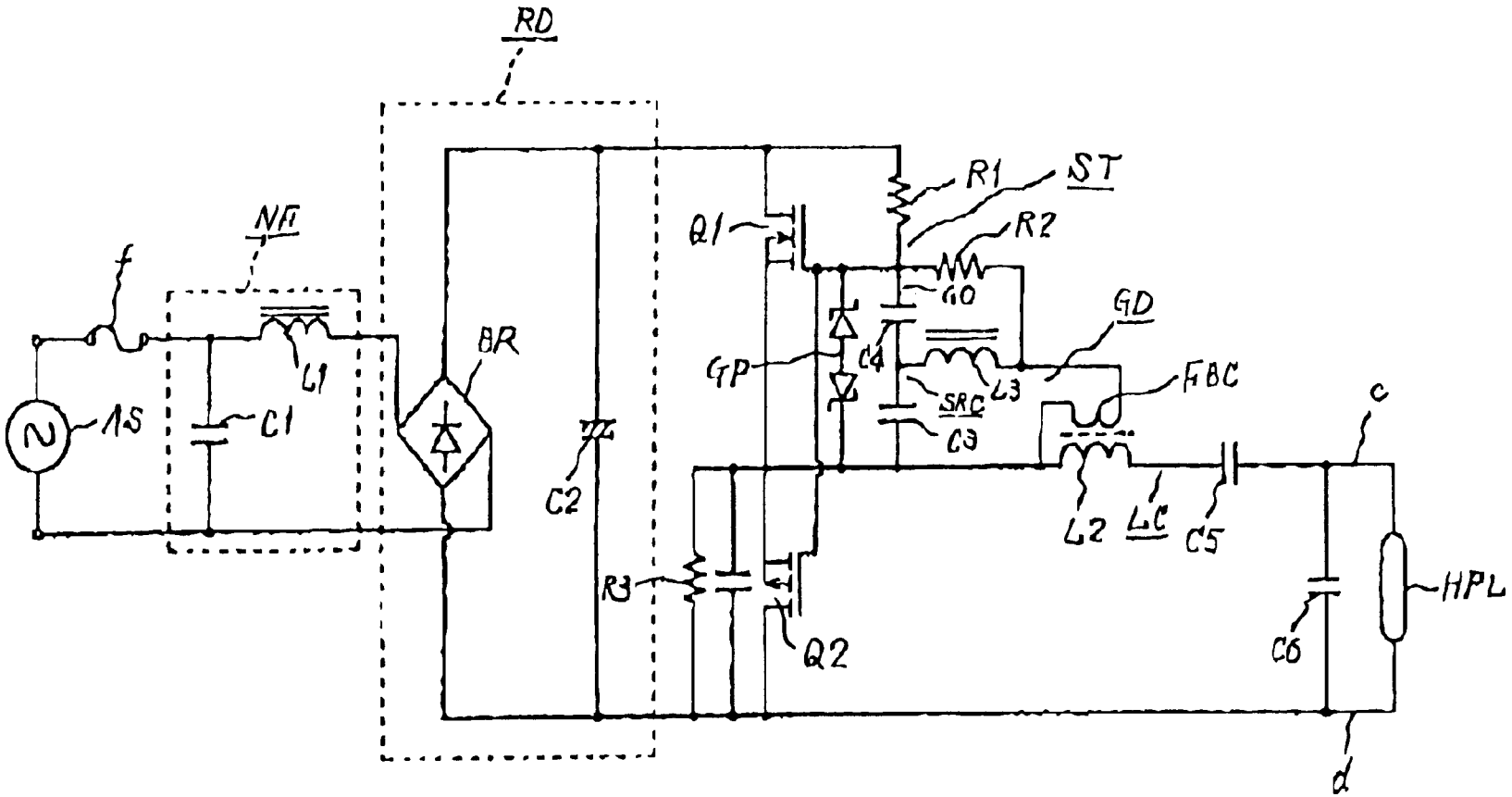
FIG. 7 is a circuit diagram showing the lighting circuit in one embodiment of the high-intensity discharge lamp device according to the present invention.

FIG. 7 is a circuit diagram showing a lighting circuit in an embodiment of the high-intensity discharge lamp lighting system according to the present invention.

In FIG. 7, AS denotes a low-frequency AC power source, f denotes an overcurrent protection fuse, NF denotes a noise filter, RD denotes a rectified DC power source, Q1 denotes a first switching device, Q2 denotes a second switching device, GD denotes a gate drive circuit, ST denotes a starting circuit, GP denotes a gate protection circuit, LC denotes a load circuit, and c, d indicate nodes across that the high-intensity discharge lamp 11 is coupled to the lighting circuit through a socket 14*b*.

The low-frequency AC power source AS means a commercial 100 V power source.

The overcurrent protection fuse f is a pattern-fuse printed on a printed circuit board. The fuse f protects the lighting circuit from its burn-out when an excessive current has flown in the lighting circuit.

The noise filter NF is comprised of an inductor L1 and a capacitor C1, and eliminates high frequency components occurring with the operation of the high frequency inverter from their incurrent to the power supply side.

The rectified DC power source RD is comprised of a bridge rectifier circuit BR and a smoothing capacitor C2. AC input terminals of the bridge rectifier circuit BR are coupled to the low-frequency AC power source AS via the noise filter NF and the overcurrent protection fuse f. DC output terminals thereof are coupled across a smoothing capacitor C2 and output a smoothed DC current.

The first switching device Q1 is comprised of an N-channel MOSFET whose drain is connected to the positive polarity terminal of the smoothing capacitor C2.

The second switching device Q2 is comprised of a P-channel MOSFET whose source is connected to the source of the first switching device Q1, while whose drain is connected to the negative polarity terminal of the smoothing capacitor C2.

Accordingly, the first and the second switching devices Q1 and Q2 are connected in series in order, and their respective polarity terminals are connected across the output terminals the rectified DC power source RD.

The gate drive circuit GD is comprised of a feedback circuit FBC, A series resonator SRC, and a gate voltage output circuit GO.

The feedback circuit FBC is comprised of an auxiliary winding which is magnetically coupled to a current limiting inductor L2.

The series resonator SRC is comprised of a series circuit of an inductor L3 and a capacitor C3 which is connected across the feedback circuit FBC.

The gate voltage output circuit GO is constituted for outputting a resonance voltage appearing across the capacitor C3 of the series resonant circuit SO via a capacitor C4. Then, one end of the capacitor C4 is coupled to the connection node of the capacitor C3 and the inductor L3, while the other end of the capacitor C4 is coupled to the gates of the first and the second switching devices Q1 and Q2. Further, the other end of the capacitor C3 is coupled to the sources of the first and the second switching devices Q1 and Q2. Accordingly, the resonance voltage appearing across the capacitor C3 is applied across the gates and the sources of the first and the second switching devices Q1 and Q2 via the gate voltage output circuit GO.

The starting circuit ST is comprised of resistors R1, R2 and R3.

One end of the resistor R1 is connected to the positive polarity terminal of the smoothing capacitor C2. The other end of the resistor R2 is connected to the gate of the first switching device Q1. The other end of the resistor R1 is also connected to the one end of the resistor R2, the output terminal of the gate voltage output circuit GO of the gate drive circuit GD and the other end of the capacitor C4.

The other end of the resistor R2 is connected to the connection node of the inductor L3 of the series resonator SRC and the feedback circuit FBC.

One end of the resistor R3 is connected to both of the first and the second switching devices Q1 and Q2, i.e., the sources of the switching devices Q1 and Q2 and the source of the gate voltage output circuit GO. While the other end of the resistor R3 is connected to the negative polarity terminal of the smoothing capacitor C2.

The gate protection circuit GP is comprised of a pair of Zener diodes connected in series and their opposite terminals connected each other, and is connected in parallel to a gate voltage output circuit GO.

The load circuit LC is comprised of a series circuit of the high-intensity discharge lamp HD, the current limiting inductor L2 and a DC-blocking capacitor C5, and a resonance capacitor C6 which is connected in parallel to the high-intensity discharge lamp HD. One end of the load circuit LC is connected to the high frequency output terminal c, and the other end is connected to the drain of the second switching device Q2.

Across the terminals c and d, the high-intensity discharge lamp HLP is coupled to the lighting circuit through the lamp socket.

The high-intensity discharge lamp HD is constituted as shown in FIGS. 1 to 3, and having the above-described specification.

The current limiting inductor L2 and the resonance capacitor C6 form together a series resonator. Here, the DC-blocking capacitor C5 has a large capacitance, and thus does not significantly affect to the series resonance.

A capacitor C7 connected across the drain and the sources of the second switching device Q2 reduces a load during the switching operation of the second switching device Q2.

Now, the circuit operation will be explained.

When the AC power source AS is powered-on, the DC voltage smoothed by the rectified DC power source RD appears across the smoothing capacitor C2. Then, the DC voltage is applied between both drains of the first and the second switching devices Q1 and Q2, which is connected in series. However, both switching means Q1 and Q2 are turned off since the gate voltage is not applied.

Since the DC voltage as mentioned above is applied to the starting circuit ST at the same time, the voltage according to the proportional distribution of the resisting values of the resistors R1, R2 and R3 principally is applied to both ends of the resistor R2. Then, the terminal voltage of the resistor R2 is applied across the gate and the source of the first and the second switching device Q1 as the positive voltage.

As the result, since the first switching device Q1 is set to exceed the threshold voltage it turns-on. However, since the voltage applied across the gate and the source of the second switching device Q2 has a polarity opposite to the gate voltage, the second switching device Q2 stays in a turned-OFF state.

When the first switching device Q1 turns ON, a current flows to the load circuit LC from the rectification DC supply source RD via the first switching device Q1. Accordingly, the higher resonance voltage appears across the terminals of the resonance capacitor C6 due to the resonance of the series resonator of the current limiting inductor L2 and the resonance capacitor C6, and then the resonance voltage is applied to the high-intensity discharge lamp HPL.

On the other hand, by the current flowing in the current limiting inductor L2 a voltage is induced in the feedback circuit FBC which magnetically couples to the current limiting inductor L2. Accordingly, since a boosted negative voltage is generated in the capacitor C3 by the series resonance of the series resonator SRC, the voltage is clipped to a fixed voltage in the gate protection circuit GP, and applied across the gate and the source of the first and the second switching devices Q1 and Q2 via the gate voltage output circuit GO.

Since the clipped fixed voltage exceeds the threshold voltage of the second switching device Q2, the second switching device Q2 turns ON.

On the contrary, the first switching device Q1 turns-off since the gate voltage is reversed its polarity.

When the second switching device Q2 turns ON, electromagnetic energy stored in the current limiting inductor L2 of the load circuit LC and charge stored in the capacitor C6 are released, and a current flows in the reverse direction in the load circuit LC from the current limiting inductor L2 via the second switching device Q2. Then a reverse polarity high resonant voltage appears across the capacitor C6 and then applied to the high-intensity discharge lamp HPL. Hereinafter, the operations as mentioned above is repeated.

By the way, since the half bridge high frequency inverter operates at the frequency which is relatively close to the resonance frequency of the series resonator comprised of the current limiting inductor L2 and the capacitor C6, before the high-intensity discharge lamp HLP starts, the second-order open-circuit voltage is about 500 V (effective voltage). That in, the second-order open-circuit voltage is about 1.0 kVp-p, and set to the voltage higher than the discharge starting voltage of the high-intensity discharge lamp HLP. Further, since the second-order short-circuit current is about 550 mA.

Accordingly, even if the igniter for generating the pulse voltage would not be used, the high-intensity discharge lamp HLP will starts lighting in a short time. After 1.4 secs, the glow-arc transition occurs, and then the rated lamp current value on the load characteristics graph moves to an operating point so as that the high-intensity discharge lamp HLP starts a stable lighting. Here, as the high-intensity discharge lamp is performed the transition with n the glow-arc transition time as mentioned above, the blackening hardly occurs at a starting operation. Here, the operating frequency while lightening is 47 kHZ.

Figure 8:
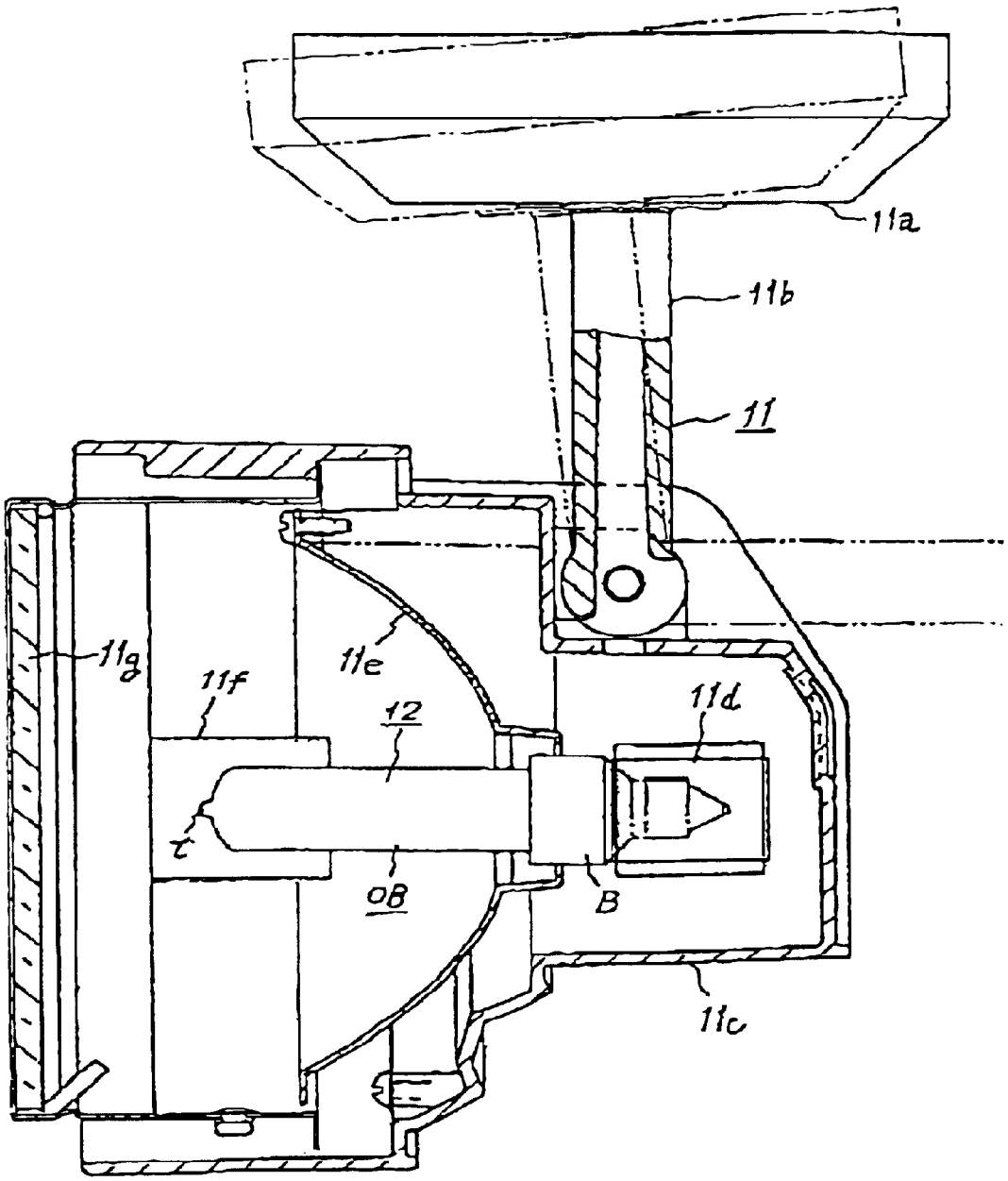
FIG. 8 is a partial section side view showing a spotlight as the first embodiment of the lighting system according to the present invention.

FIG. 8 is a partial center-section side view of a spotlight type high-intensity discharge lamp as a first embodiment of the lighting device according to the present invention.

In FIG. 8, 11 denotes a spotlight main-body, and 12 denotes a high-intensity discharge lamp.

The spotlight main-body 11 is mainly provided with a ceiling base 11*a*, an arm 11*b*, a main-body case 11*c*, a lamp socket 11*d*, a reflector 11*e*, a light-shield cylinder 11*f* and a front glass 119.

The ceiling base 11*a* hangs the spotlight by mounted on the ceiling, and it is coupled to the lighting circuit (not shown) which is mounted behind the ceiling to receiving the power.

The outside end of the arm 11*b* is fixed to the ceiling base 11*a*.

The main-body case 11*c* has an opening at its front, and is pivoted on the free-end of the arm 11*b* in freely rockable in a vertical plane. Here, the range that the arm 11*b* is able to rock in reference to the main-body case 11*c* is illustrated by the two-dot chain line in FIG. 8.

The lamp socket 11*d*, which fits to the E11-type screw-base, is placed inside the main-body case 11*c*.

The reflector 11*e* is placed in front of the lamp socket 11*d*, and mounted on the main-body case 11*c*.

The light-shield cylinder 11*f* is mounted on the middle portion of the opening edge of the reflector 11*e*.

The front glass 119 is mounted on the opening edge of the main-body case 11*c*.

Figure 9:
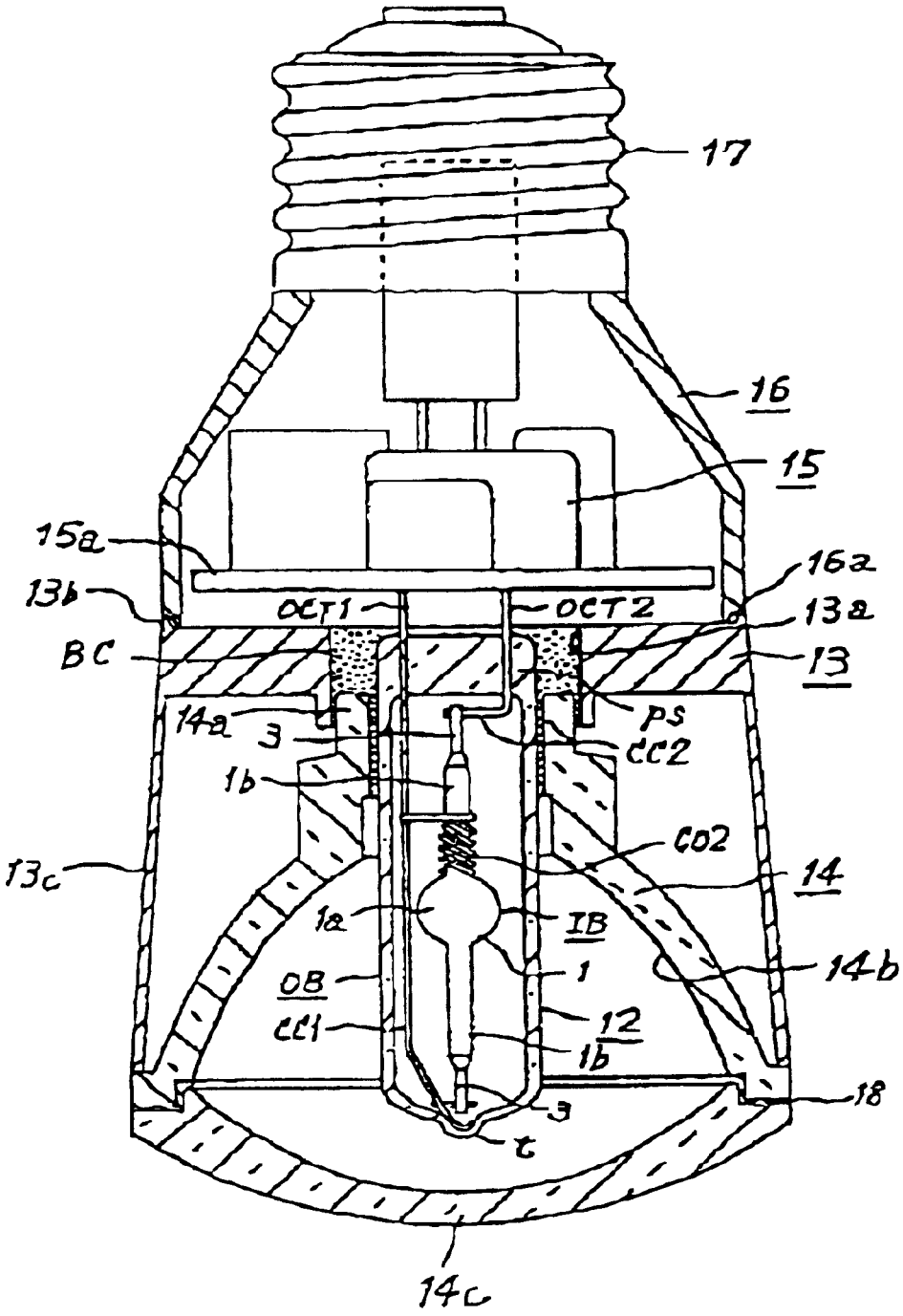
FIG. 9 is a partial section front view showing the screw-base-mount type high-intensity discharge lamp as the second embodiment of the lighting system according to the present invention.

The high-intensity discharge lamp 12 has the same specifications as those, as shown in FIGS. 1 to 3, the same elements, as those shown in the drawings, are assigned with the same marks and omitted the explanation. The, the high-intensity discharge lamp 12 is installed to the spotlight main-body 11 by mounting the screw-base B of the high-intensity discharge lamp 12 to the lamp socket 11*d*. Further, the light-shield cylinder 11*f* shields the light coming from the inside end of the jacket-bulb OB when the high-intensity discharge lamp 12 is installed to the spotlight main-body, so as to prevent glare. FIG. 9 is a partial section front view of the screw-base-mount type high-intensity discharge lamp as the fourth embodiment of the high-intensity discharge lamp and also as the second embodiment of the lighting device according to the present invention.

In FIG. 9, the screw-base-mount type high-intensity discharge lamp is provided with a high-intensity discharge lamp 12, a pedestal 13, a reflector 14, a lighting circuit 15, a base body 16 and a screw-base 17.

The above components will be respectively explained hereinafter.

High-Intensity Discharge Lamp 12

The high-intensity discharge lamp 12 has almost the same specifications as the high-intensity discharge lamp, as shown in FIG. 5, except the screw-base portion. In FIG. 9, the outer lead terminals OCT1 and OCT2 protrude upward from the pinch-sealed portion ps of the jacket-bulb OB. Here, in FIG. 9, the same elements as those, as shown in FIG. 5, are assigned with same marks and omitted the explanation.

Pedestal 13

The pedestal 13 is made of heat-resistant synthetic resin. The pedestal 13 has a mounting hole 13*a* in its center portion, a mounting portion 13*b* around its upper peripheral portion and a conical skirt 13*c* on its lower peripheral portion.

The mounting hole 13*a* is adapted for mounting the high-intensity discharge lamp 12 and the reflector 14 on the pedestal 13. The pinch-sealed portion ps of the high-intensity discharge lamp 12 and the outside end 14*a* of the reflector 14 are inserted into the mounting hole 13*a* and then fixed thereto inorganic adhesive BC.

The mounting portion 13*b* is fixed to the opening edge of the base body 16.

The conical skirt 13*c* covers the reflector 14 for protection thereof and enhancing its appearances.

Reflector 14

The reflector 14 is placed around the high-intensity discharge lamp 12 and covers at least the light-emitting portion, that is the enclosure 1*a* of the high-intensity discharge lamp 12. Accordingly the reflector 14 is fixed an the pedestal 13. In the present embodiment as mentioned above, the high-intensity discharge lamp 12 is fixed on the pedestal 13 together with the reflector 14.

Further, the reflector 14 is formed in a bowl shape by glass and has a cylindrical edge 14*a* integrally-formed on the top of the bowl. And a reflecting surface 14*b* is formed on the inside surface of the bowl-shape reflector by an evaporated aluminum film. The edge portion 14*a* is inserted into the mounting hole 13*a* of the pedestal 13, and then fixed to the pedestal 13 through the inorganic adhesive BC.

Further, a front glass 14*c* is mounted on the opening portion of the reflector 13. The front glass 14*c* is made of transparent glass, and hermetically sealed to the reflector 14 through frit glass 18 with a low melting point.

Furthermore, nitrogen as inert-gas is filled in the space defined by the reflector 14 and the front glass 14*c*.

Lighting Circuit 15

The lighting circuit 15 is mainly mounted on the upper side of the wiring board 15*a* in the drawing. And it accepts the outer lead terminals OCT 1 and OCT 2 of the high-intensity discharge lamp 12 from the lower side of the wiring board 15*a* so as to connect to the wiring board 15*a* suitably.

Further, the lighting circuit 15 has the same circuit construction as that, as shown in FIG. 6.

Base Body 16

The base body 16 is shaped like a cup. A screw-base 17 as described below is coupled to the base portion, and an outer-edge step 16*a* is formed on the opening edge of the base body 16. Further the base body 16 accommodates therein the lighting circuit 15. Further, an outer-edge step 13*c* of the pedestal 13 fits into the outer-edge step 16*a* of the opening edge and then they are fixed by the inorganic adhesive. Here, holes or gaps for draining air out or dissipating heat are defined at a right place on the base body 16 or a fitting place thereof to the pedestal, as needed.

Screw-Base 17

The screw-base 17 is comprised of the E26 type screw-base, and placed on the base body 16.

According to the first to tenth aspects of the invention, there are provided a lighting-source bulb provided with a discharge lamp light-transmissive ceramic, a pair of electrodes and discharge agent, a metallic coil which is wound on the outside surface of at least one of the small-diameter cylinders of the light-transmissive ceramic discharge enclosure and coupled to have the same potential as the other end of the coil, delight jacket-bulb for accommodating the lighting-source bulb and the metallic coil mentioned above hermetically, a pair of outer lead terminals which are coupled to the pair of electrodes of the lighting-source bulb and hermetically led outside the jacket-bulb. So that it is provide the high-intensity discharge lamp which is effective for the compact lighting circuit with much lower starting voltage, and for the expanding the glow-arc transition time.

According to the second aspect of the invention, since there are provided a first metallic coil which is wound on the small-diameter cylinder wherein the first electrode is inserted through so as to have the same potential as the second electrode, and the second metallic coil which is wound on the small-diameter cylinder through which the second electrode extends so as to have the same potential as the first electrode, it is able to provide a high-intensity discharge lamp which is effective for the compact lighting circuit with much lower starting voltage, and for the expanding the glow-arc transition time.

According to the third aspect of the invention, since the first metallic coil is electrically isolated from other elements, and the second metallic coil is coupled to be the same potential as the other electrode, it is able provide a high-intensity discharge lamp which is effective for the compact lighting circuit by decreasing the starting voltage and for expanding the glow-arc transition time.

According to the fourth aspect of the invention, since the metallic coil has four turns or more, it is able to provide the high-intensity discharge lamp which is suitable for decreasing the starting voltage.

According to the fifth aspect of the invention, since one end of the metallic coil is placed near the boundary of the enclosure of the light-transmissive ceramic discharge enclosure, it is able to provide the high-intensity discharge lamp which is easy to place and fix the metallic coil.

According to the sixth aspect of the invention, since the winding pitch of the metallic coil resides in the range of 100% to 500%, it is able to provide the high-intensity discharge lamp wherein the winding operation is easy and the starting voltage lowers effectively.

According to the seventh aspect of the invention, since the value of L1/L2 will be 0.3 to 1.0 when the length of the metallic coil is denoted as L1 and the length of the small-diameter cylinders of the light-transmissive ceramic discharge enclosure is denoted as L2, it is able to provide the high-intensity discharge lamp providing the suitable length of the metallic coil.

According to the eighth aspect of the invention, since one end of the metallic coil which placed on the opposite end of the enclosure of the light-transmissive ceramic discharge enclosure is coupled to the other end of the electrode, it is able to provide the high-intensity discharge lamp wherein the distribution of the light is not disturbed and the metallic coil is easily coupled.

According to the ninth aspect of the invention, since the electrostatic capacitance across the pair of outer lead terminals are from 1.2 to 4.0 pF, it is able to provide the high-intensity discharge lamp wherein the stating voltage lowers and the glow-arc transition time is able to be controlled.

According to the tenth aspect of the invention, since the metallic coil is wound on the axis of the electrode in the place where at least one of the electrodes faces to the metallic coil, it is able to provide the high-intensity discharge lamp wherein the starting voltage lowers and the glow-arc transition time is able to be controlled.

According to the eleventh aspect of the invention, it is able to provide the high-intensity discharge lamp lighting system performing the effects according to any one of the first to tenth aspects of the invention.

According to the twelfth aspect of the invention, it is able to provide the lighting system performing the effects according to any one of the first to tenth aspects of the invention.

As described above, the present invention can provide an extremely preferable high-intensity discharge lamp, a system for lighting the lamp and a lighting appliance using the lamp.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefor, it is intended that the present invention not be limited to the particular embodiment disclosed as the best mode contemplated for carrying out the present invention, but that the present invention includes all embodiments falling within the scope of the appended claims.

The foregoing description and the drawings are regarded by the applicant as including a variety of individually inventive concepts, some of which may lie partially or wholly outside the scope of some or all of the following claims. The fact that the applicant has chosen at the time of filing of the present application to restrict the claimed scope of protection in accordance with the following claims is not to be taken as a disclaimer or alternative inventive concepts that are included in the contents of the application and could be defined by claims differing in scope from the following claims, which different claims may be adopted subsequently during prosecution, for example, for the purposes of a divisional application.

What is claimed is:

1. A high-intensity discharge lamp, comprising:

a lighting-source bulb provided with a light-transmissive ceramic discharge enclosure containing an enclosure defining a discharge space and a pair of small-diameter cylinders communicating with the enclosure at both ends thereof and having an inside diameter smaller than the enclosure, a first and a second slender electrodes extending through the small-diameter cylinders of the light-transmissive ceramic discharge enclosure in leaving narrow gaps between the inside surfaces of the small-diameter cylinders and the electrodes and discharge agent filled in the light-transmissive ceramic discharge enclosure;

a first metallic coil which is wound on the outside surface of the one end of the small-diameter cylinder wherein the first electrode is inserted through and which is coupled to have the same potential as the second electrode;

a second metallic coil which is wound on the other small-diameter cylinder through which the second electrode extends, and which is coupled to the first electrode to have the same potential as the electrode;

a jacket-bulb which accommodates the lighting-source bulb and the first and the second metallic coils hermetically; and a pair of outer lead terminals which are coupled to the first and second electrodes and hermetically led outside the jacket-bulb.

2. A high-intensity discharge lamp, comprising:

a lighting-source bulb provided with a light-transmissive ceramic discharge enclosure containing an enclosure defining a discharge space and a pair of small-diameter cylinders communicating with the enclosure at both ends thereof and having an inside diameter smaller than the enclosure, a pair of slender electrodes extending through the small-diameter cylinders of the light-transmissive ceramic discharge enclosure in leaving narrow gaps between the inside surfaces of the small-diameter cylinders and the electrodes and discharge agent filled in the light-transmissive ceramic discharge enclosure;

a first metallic coil which is wound on the outside surface of the one end of the small-diameter cylinder wherein one of the electrodes is inserted through, and which is coupled to the other electrode to have the same potential as the electrodes;

a second metallic coil which is wound on the other small-diameter cylinder wherein the other electrode is inserted through;

a jacket-bulb which accommodates the lighting-source bulb and the first and the second metallic coils hermetically; and a pair of outer lead terminals which are coupled to a pair of electrodes and hermetically led outside the jacket-bulb.

3. A high-intensity discharge lamp according to claim 1 or 2, wherein the metallic coil is wound on the small-diameter cylinder more than four turns.

4. A high-intensity discharge lamp according to claim 3, wherein, one end of the metallic coil is placed near the boundary of the enclosure of the Light-transmissive ceramic discharge enclosure.

5. A high-intensity discharge lamp according to claim 4, wherein, the winding pitch of the metallic coil resides in the range of 100% to 500%.

6. A high-intensity discharge lamp according to claim 5, wherein the value of L1/L2 will be 0.3 to 1.0, when the length of the metallic coil is denoted as L1 and the length of the small-diameter cylinders of the light-transmissive ceramic discharge enclosure is denoted as L2.

7. A high-intensity discharge lamp according to claim 6, wherein one end of the metallic coil which resides in a side opposite to the enclosure of the light-transmissive ceramic discharge enclosure is coupled to the opposite side electrode to have the same potential as that of the electrode.

8. A high-intensity discharge lamp according to claim 7, wherein the electrostatic capacitance across the pair of outer lead terminals are among 1.2 to 4 pF.

9. A high-intensity discharge lamp according to claim 8, wherein the electrode is provided with a third metallic coil, which is wound on at least a part of the electrode's axis and1 faces to the metallic coil.

10. A lighting appliance, comprising:

a lighting appliance principal body, and a high-intensity discharge lamp lighting system as claimed in claim 9 which is mounted on the lighting appliance principal body.

* * * * *

UNITED STATES PATENT AND TRADEMARK OFFICE

CERTIFICATE OF CORRECTION

PATENT NO. : 6,713,961 B2
DATED : March 30, 2004
INVENTOR(S) : Hisashi Honda et al.

It is certified that error appears in the above-identified patent and that said Letters Patent is hereby corrected as shown below:

Title page,
Item [75], Inventors, please replace 4th Inventor's last name with -- Kawatsuru --.

Signed and Sealed this

Twenty-first Day of December, 2004

JON W. DUDAS
*Director of the United States Patent and Trademark Office*